United States Patent [19]

Baughman et al.

[11] Patent Number: 4,461,404

[45] Date of Patent: Jul. 24, 1984

[54] APPARATUS FOR MOVING AN ADHESIVE APPLICATOR

[75] Inventors: Richard C. Baughman, Geneseo; David S. Bump, Rochester, both of N.Y.

[73] Assignee: Eastman Kodak Company, Rochester, N.Y.

[21] Appl. No.: 380,964

[22] Filed: May 24, 1982

[51] Int. Cl.[3] ..... B05B 15/02

[52] U.S. Cl. ..... 222/148; 222/160; 73/864.22; 118/302; 141/270; 239/106

[58] Field of Search ..... 222/148, 160; 141/270, 141/272, 284; 118/302; 239/106; 73/864.11, 864.12, 864.22; 134/119

[56] References Cited

U.S. PATENT DOCUMENTS 2,245,657 6/1941 Eppler, Jr. .
2,999,517 9/1961 Cervinka ..... 141/270 X
3,740,041 6/1973 Jones .
3,908,869 9/1975 Little .
4,158,035 6/1979 Haase et al. ..... 73/864.11 X

OTHER PUBLICATIONS

Article Entitled Adhesive Applicators for High Speed Machines—pp. 56–59.

*Primary Examiner*—Joseph J. Rolla
*Assistant Examiner*—Frederick R. Handren
*Attorney, Agent, or Firm*—G. Herman Childress

[57] ABSTRACT

An adhesive applicator for applying an air-curable adhesive to sheets of paper has a nozzle that normally is located in a storage position with the end of the nozzle inserted into a liquid in a sump. This prevents adhesive material in the end of the nozzle from drying out or caking and thereby clogging the end of the nozzle. When the nozzle is to be used for applying adhesive, the nozzle is lifted out of the sump, the sump is pivoted away from the nozzle, and the nozzle is then moved into an operating position for applying the adhesive.

4 Claims, 5 Drawing Figures

APPARATUS FOR MOVING AN ADHESIVE APPLICATOR

CROSS REFERENCE TO RELATED APPLICATIONS

Reference is made to commonly assigned, copending U.S. patent applications Ser. No. 380,965, entitled METHOD AND APPARATUS FOR MOVING A NOZZLE BETWEEN A STORAGE POSITION AND A POSITION FOR APPLYING A FLUID, filed on even date herewith in the names of R. C. Baughman and D. S. Bump, and Ser. No. 380,966, entitled BINDING APPARATUS AND METHOD, filed on even date herewith in the names of R. C. Baughman, D. S. Bump and C. R. Hubbard.

BACKGROUND OF THE INVENTION

The invention relates to an improvement in apparatus for moving a nozzle of an adhesive applicator between a storage position and a position for applying a adhesive.

U.S. Pat. No. 3,908,869 issued on Sept. 30, 1975 in the name of W. A. Little and is entitled Method and Apparatus for Dispensing Air-curable Viscous Materials. Such patent discloses apparatus and method for dispensing an air-curable material, such as a silicone rubber, without allowing the material to partially cure and clog portions of the dispensing system. Clogging of the system is avoided by immersing the dispensing end of the nozzle in a reservoir of liquid, such as oil, when the nozzle is not being used. The oil forms an air tight seal around the end of the nozzle. After the nozzle is immersed in the oil, all air-contacted material in the nozzle is purged from the nozzle into the oil and then a back pressure is applied to the material in the nozzle to draw part of it upwardly into the nozzle and thus draw some of the oil from the reservoir into the nozzle. The apparatus of the Little patent is described as useful for forming a silicone rubber gasket by removing the nozzle from the reservoir and passing it along a predetermined path above a work surface while dispensing rubber through the nozzle to thereby form the gasket.

It also is known to clean a nozzle that is moved through a series of liquids, such as liquids in test tubes, in order to prevent contamination of samples in the various test tubes. See, for example, U.S. Pat. No. 3,740,041 which issued on June 19, 1973 in the name of A. R. Jones for Reagent Mixing Apparatus.

U.S. Pat. No. 2,245,657 issued on June 17, 1941 to A. Eppler for Apparatus for Applying Adhesive to Shoe Parts, discloses a glue pot from which adhesive is pumped through openings leading into the central portion of a brush. When the use of the apparatus is to be discontinued for substantial period of time, the glue can be prevented from hardening in the brush by raising about the brush a cup or container having therein water or other liquids.

U.S. patent application Ser. No. 380,965, mentioned above, discloses a nozzle for an adhesive applicator mounted for movement between a storage position and a position for applying adhesive. In response to movement of the nozzle between its positions a sump is moved between a position for receiving an end of the nozzle (when the nozzle is moved into its storage position) and a position spaced from the end of the nozzle (when the nozzle is moved to its position for applying fluid). Such application also discloses automatically repositioning the nozzle in the sump during periods when the nozzle is not applying fluid. While the apparatus of such application is satisfactory for its intended function, it is desirable to provide a simplified, positive acting apparatus as disclosed herein.

SUMMARY OF THE INVENTION

An adhesive dispensing apparatus of the present invention includes a mechanism plate. A cam plate is pivotally connected to one surface of the mechanism plate and the cam plate has a cam surface. A cam member is engageable with the cam surface of the cam plate. Drive means are provided for moving the cam member relative to the cam surface to effect pivotal movement of the cam plate. A sump is carried by the cam plate and is movable with the plate between a first position and a second position. An adhesive applicator having a nozzle is mounted on a carrier. The carrier is coupled to the cam member so that movement of the cam member effects movement of the carrier and the applicator to locate the applicator nozzle in the sump when the sump is in its first position and to locate the nozzle out of the sump and in a position for dispensing adhesive when the sump is in its second position.

The invention, and its objects and advantages, will become more apparent in the detailed description of the preferred embodiment presented below.

BRIEF DESCRIPTION OF THE DRAWINGS

In the detailed description of the preferred embodiment of the invention presented below, reference is made to the accompanying drawings, in which:

FIG. 1 is a view of a mechanism of the invention showing the nozzle in the storage position;

FIG. 2 is a view similar to FIG. 1 showing the parts in an intermediate position after initial movement of the nozzle away from the storage position and before the nozzle reaches its operating position;

FIG. 3 is a view similar to FIGS. 1 and 2 but showing the nozzle in its operating position for applying fluid to a sheet of paper or the like;

DESCRIPTION OF THE PREFERRED EMBODIMENT

Figures 1, 2, 3:
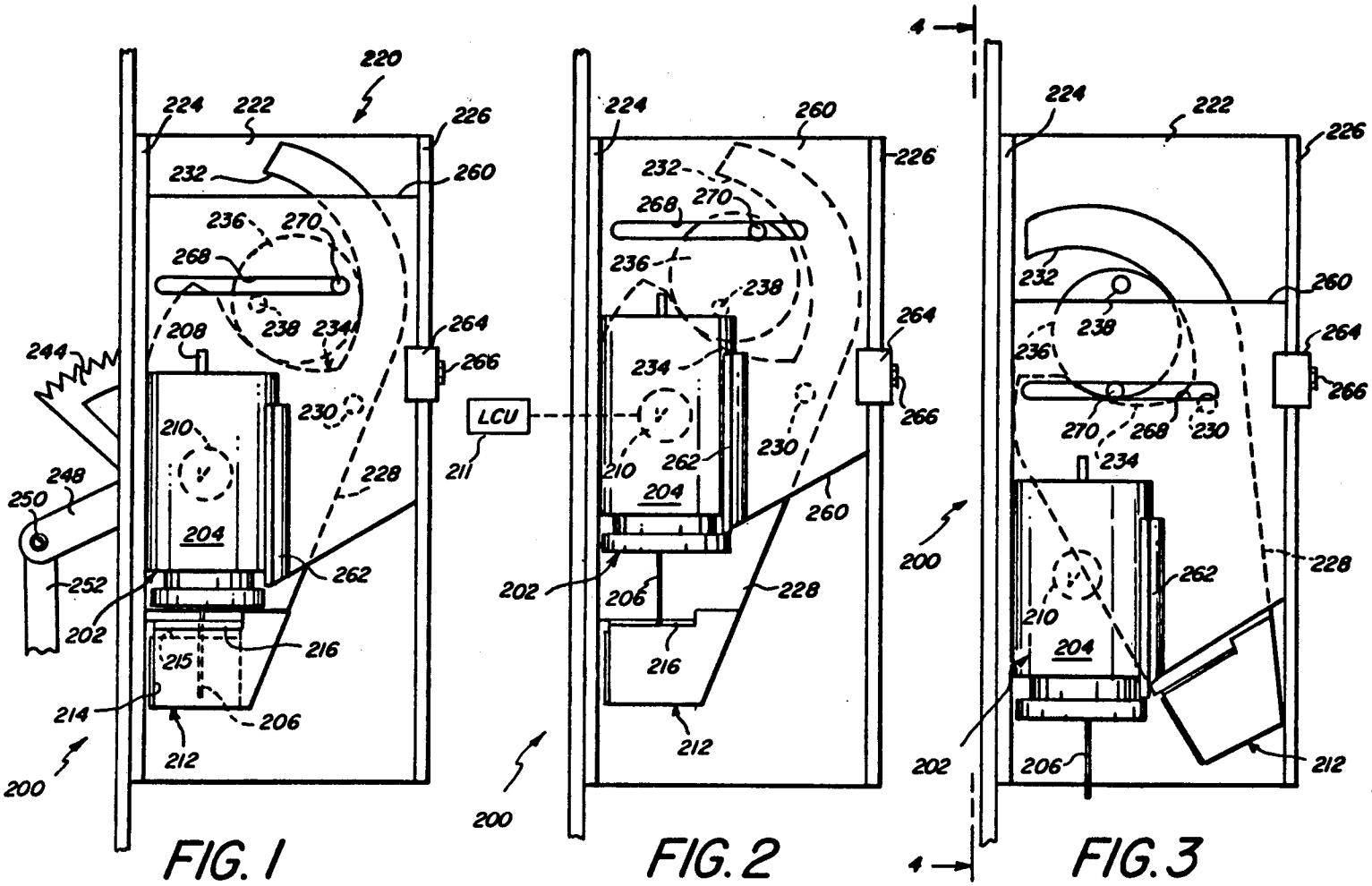
Figure 4:
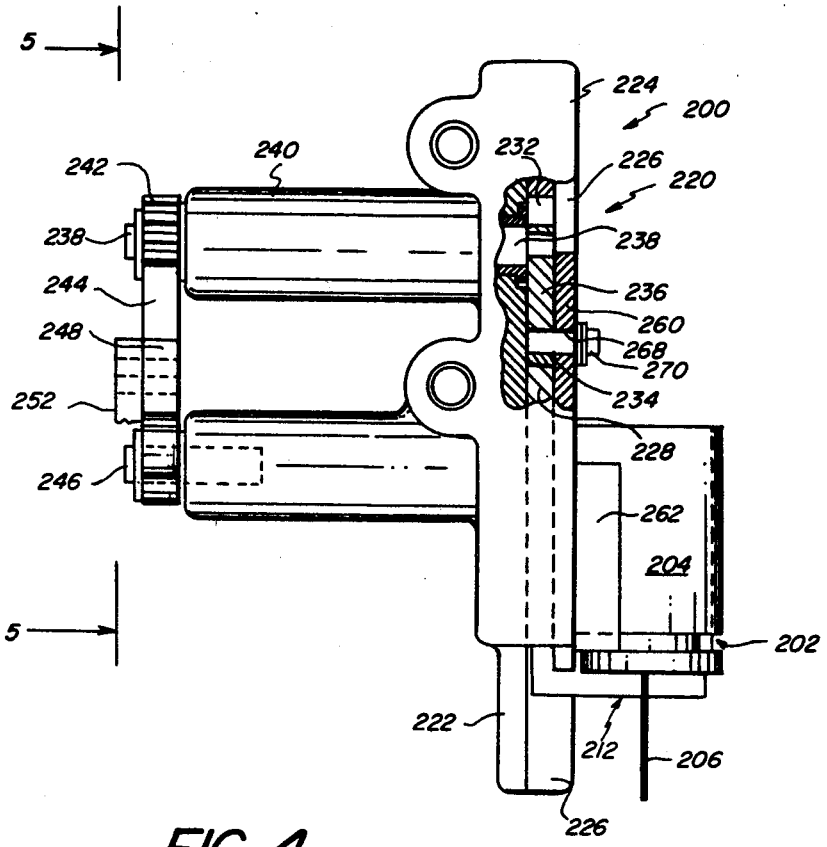
FIG. 4 is an elevation view, partly broken away, taken along line 4—4 of FIG. 3.

Referring now to the drawings in detail, a preferred embodiment of the apparatus of the present invention includes an adhesive applicator generally designated 200. The applicator 200 includes a nozzle assembly 202 that can be moved between a storage position shown in FIG. 1 and an adhesive applying position shown in FIG. 3. The nozzle assembly comprises a cylindrical housing 204, a nozzle tip 206 through which adhesive is dispensed, and an inlet port 208 through which adhesive is supplied to the nozzle assembly. The nozzle assembly 202 preferably includes a solenoid operated valve 210 which is under control of a logic and control unit 211 (FIG. 2). Valve 210 controls the flow of adhesive through the applicator in response to signals from the LCU.

When the nozzle assembly is in its FIG. 1 storage position the tip 206 of the nozzle is located in a sump generally designated 212. As the nozzle assembly is moved from its storage position to its FIG. 3 operating position, the sump is swung to the side away from the path of movement of the nozzle assembly.

Sump 212 comprises a hollow container 214 having on the top thereof a seal 216 of rubber or similar elastomeric material. Preferably, container 214 is formed of a clear transparent material. The container holds a liquid solvent 215 (FIG. 1), such as water, for the adhesive material being dispensed through the nozzle. Thus when the nozzle tip end 206 is in the sump any material in the lower end of the nozzle will not dry out or clog the end of the nozzle. By making the container 214 of a transparent material a machine operator can visually determine if there is sufficient liquid in the container to cover the tip end of the nozzle. The seal 216 substantially prevents spilling and drying of the liquid in the container. Suitable detectors (not shown), such as mechanical switches or emmitter-detectors, can be used to sense the presence of the applicator at its operating position or its storage position and to provide a signal to LCU 211.

A mechanism generally designated 220 is provided for moving the sump 212 between the two positions shown in FIGS. 1 and 3. Such movement of the sump occurs simultaneously with movement of the nozzle assembly 202 between its storage position (FIG. 1) and its operating position (FIG. 3). Mechanism 220 comprises a generally U-shaped guideway formed by a mechanism plate 222 and rails 224 and 226 located at side edges of the plate. The rails are generally perpendicular to the plate and secured thereto.

A cam plate 228 is pivotally mounted on plate 222 by a pivot pin 230. The sump 212 is secured to the lower end of the cam plate 228. An opening in the upper end of the cam plate is defined by two arcuate cam follower surfaces 232 and 234 which meet adjacent to the pivot 230. A circular cam 236 fits between the cam follower surfaces 232 and 234 with one face of the cam being adjacent the surface of the plate 222. A drive shaft 238 is journaled in a housing 240 projecting from the rear of plate 222. One end of the drive shaft 238 is connected to the cam 236 and the axis of the shaft 238 is offset from the center of the cam 236 so that rotation of the shaft is effective to cause eccentric movement of the cam about the axis of the shaft.

Figure 5:
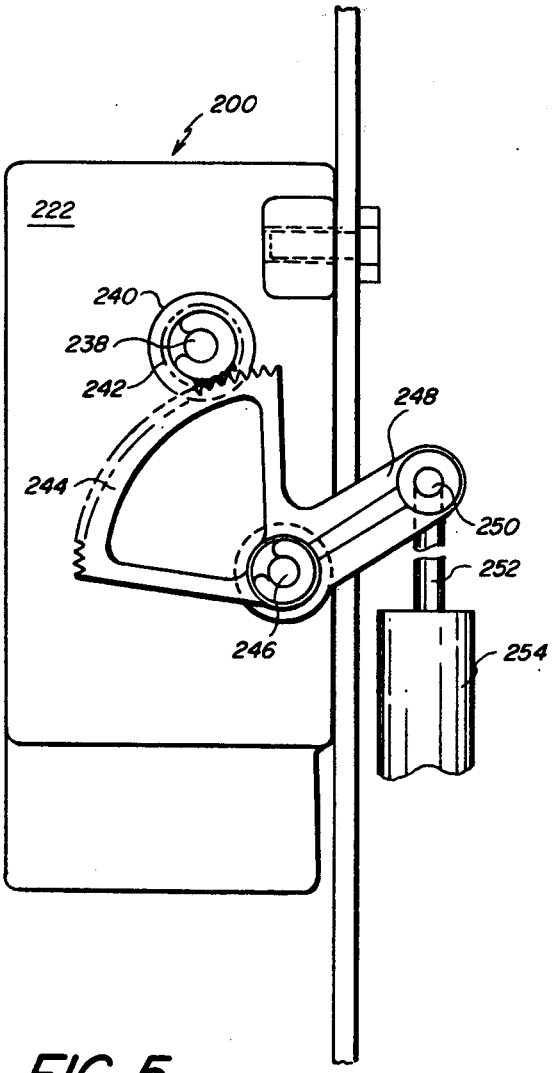
FIG. 5 is an elevation view taken along line 5—5 in FIG. 4.

The end of the shaft 238 opposite from the cam has a gear 242 mounted thereon. Gear 242 is driven from a gear sector 244 that pivots about a shaft 246. The sector has an integral arm portion 248 that is connected at 250 to a rod 252 of a pneumatic cylinder 254 (FIG. 5). Thus when the cylinder 254 is supplied with air under pressure, rod 252 is extended to effect rotation of gear sector 244 and thereby rotate the gear 242 and the drive shaft 238 to turn the cam 236. When pneumatic pressure is released, a return spring in the cylinder 254 effects movement of the parts in the opposite direction.

When cam 236 is driven in a clockwise direction from the position shown in FIG. 3, the edge of cam 236 engages the cam follower surface 232 to swing plate 228 in a clockwise direction about pivot 230, thereby to bring the plate and sump 212 to the position illustrated in FIG. 1. When cam 236 is driven in a counterclockwise direction from the position shown in FIG. 1, the edge of cam 236 engages cam follower surface 234 to drive the plate 228 in a counterclockwise direction about pivot 230, thereby moving the plate and the sump 212 to the FIG. 3 position.

A plate 260 is positioned between the side rails 224, 226 and adjacent to the surface of the cam plate 228. A nozzle mounting member 262 is secured to the surface of plate 260 opposite from the cam plate 228, and the nozzle assembly 202 is held by the mounting member 262.

The plate 260 is retained in its position between rails 224, 226 by a retainer 264 that is secured to rail 226 by a fastener 266. The retainer 264 has a flange portion that overlies part of the plate 260 to prevent it from moving away from the cam plate 228. A lip (not shown) can be provided on the outer edge of rail 224 to limit movement of plate 260 away from cam plate 228. Thus the plate is mounted for reciprocating movement in a vertical direction and in a plane parallel to and adjacent to the surface of cam plate 228.

Plate 260 has a narrow slot 268 that extends horizontally across the upper end portion of the plate. A pin 270 is eccentrically mounted on the cam 236 and projects through slot 268 in plate 260. As the cam is rotated about the axis of shaft 238, pin 270 swings through an arcuate path about the axis of shaft 238 and also travels along slot 268, thereby effecting vertical reciprocating movement of plate 260 between rails 224, 226 and in a plane generally parallel to the plate 222. The applicator assembly is carried by the plate 260 and therefor also reciprocates vertically as the plate is moved. Thus the applicator assembly 202 is moved first vertically upwardly from its FIG. 1 storage position to its FIG. 2 elevated position as the cam is rotated approximately 90° counterclockwise, and then the applicator assembly is moved downwardly from its FIG. 2 position to its FIG. 3 operating position as the cam rotates an additional 180° counterclockwise. Reverse movement of the cam effects movement of the applicator assembly from the FIG. 3 position upwardly to the FIG. 2 position and then back downwardly to the FIG. 1 position.

As the cam moves counterclockwise from the FIG. 1 to the FIG. 2 position, the cam moves freely within the opening defined by cam followers 232, 234 of the cam plate 228. Therefore, the plate remains in its FIG. 1 position during such movement of the cam. Further counterclockwise movement of the cam from its FIG. 2 position causes the cam to engage the surface of cam follower 234 and thereby swing the cam plate about pivot 230 from its FIG. 2 position to its FIG. 3 position. Such movement swings the sump 212 to the right and out of the path of movement of the applicator assembly as the assembly moves from its most elevated position illustrated in FIG. 2 to its operating position illustrated in FIG. 3.

As mentioned previously, rotation of the cam 236 is effected by a pneumatic cylinder 254 which has a spring for returning rod 252 to the cylinder when pneumatic pressure is removed. As a result, the adhesive applicator assembly 202 and the sump 212 are returned from their FIG. 3 positions to their FIG. 1 positions for storage in the event of a power failure which would shut off the source of the pneumatic pressure. This is desireable because it returns the end 206 of the applicator to the sump 212 so that adhesive in the end of the applicator will not dry out and clog the system.

Operation of the apparatus will now be described. During the periods of non-use the nozzle tip 206 is located in the storage position illustrated in FIG. 1. At this time the nozzle tip is positioned inside the sump 212 and is covered by the liquid solvent 215 to prevent drying out or clogging of the adhesive material in the lower end of the nozzle tip. When it is desired to use the nozzle for applying adhesive, pneumatic cylinder 254 is energized with air or other gas under pressure to extend the rod 252 and thereby effect movement of the gear sector 244 to rotate the drive shaft 238 in a counterclockwise direction as viewed in FIGS. 1–3. Rotation of shaft 238 drives the cam 236 in an eccentric path about the axis of shaft 238 from its FIG. 1 position through its FIG. 2 position to its FIG. 3 position. As this occurs the pin 270 travels along the slot 268 in the cam plate 228.

During initial movement of the parts from the FIG. 1 to the FIG. 2 position, cam plate 228 remains stationary while the plate 260 is lifted upwardly by movement of the pin 270 along the slot 268. Cam 236 rotates freely within the cam surfaces 232, 234 at this time without causing movement of the cam plate 228. This brings the part to the position illustrated in FIG. 2 where the nozzle tip 206 has been lifted out of the sump 212. Further rotation of shaft 238 in a counterclockwise direction causes cam 236 to engage cam follower surface 234 and thereby swing the cam plate 228 from the FIG. 2 position to the FIG. 3 position where the sump 212 is located to the right of the path of movement of the nozzle tip 206. Promptly after the sump has been swung to the side to its FIG. 3 position, pin 270 drives plate 260 downwardly, thereby lowering the nozzle tip 206 to its operating position shown in FIG. 3. At this time valve 210 can be opened in response to a signal from the LCU 211 to effect flow of adhesive out of the tip 206 onto a sheet of paper, for example, (not shown) as relative movement is effected between the nozzle and the sheet of paper. Such relative movement may occur by movement of the sheet of paper past the tip of the nozzle as described in more detail in the beforementioned U.S. patent application Ser. No. 380,966.

After application of the adhesive is completed, the air or the gas under pressure supplied to cylinder 254 is shut off to allow the return spring in the cylinder to retract the rod 252. This moves the gear sector 244 and gear 242, thereby to effect rotation of drive shaft 238 in a clockwise direction as viewed in FIGS. 1–3. During initial movement of the drive shaft in a clockwise direction from its FIG. 3 position, plate 260 is raised from its FIG. 3 to its FIG. 2 position due to movement of pin 270 in slot 268. After the plate 260 has been raised to its FIG. 2 position, the cam 236 engages cam follower surface 232 to pivot the cam plate 228 from its FIg. 3 position to its FIG. 2 position and thereby locate the sump 212 in a position immediately beneath the tip 206 of the nozzle as shown in FIG. 2.

Continued rotation of drive shaft 238 in a clockwise direction causes pin 270 to move from its FIG. 2 position to its FIG. 1 position, thereby driving plate 260 downwardly and causing tip 206 of the nozzle assembly to penetrate seal 216 and be inserted into the sump 212 to a point where it is beneath the level of the solvent 215 in the sump. Because this return movement of the parts from the FIG. 3 position to the FIG. 1 position is effected by a return spring in the cylinder 254, such return movement will be accomplished anytime there is a failure in power, etc. which is effective to shut off the supply of fluid under pressure to the cylinder 254. Thus the nozzle is returned to the sump to prevent clogging of adhesive in the end of the nozzle in the event of inadvertent shut down of the apparatus.

The apparatus of this invention provides a relatively simple mechanism for moving the nozzle and sump between their respective positions and also effects return of the nozzle to the sump in case of power failure, etc. The use of the cam and cam followers, and the pin 270 and slot 268, provide positive control of the parts during movement and insures precise positioning of the parts in their operating and storage positions.

The invention has been described in detail with particular reference to a preferred embodiment thereof, but it will be understood that variations and modifications can be effected within the spirit and scope of the invention as described hereinabove and as defined in the appended claims.

We claim:

1. In an adhesive dispensing apparatus, the improvement comprising:

a pivotally mounted cam plate having a cam surface;

a cam member engageable with the cam surface of the cam plate;

drive means for moving the cam member relative to the cam surface to effect pivotal movement of the cam plate;

a sump carried by the cam plate and movable with the plate between a first position and a second position;

an adhesive applicator having a nozzle; and a carrier for the adhesive applicator, the carrier being coupled to the cam member so that movement of the cam member effects movement of the carrier and the applicator to locate the applicator nozzle in the sump when the sump is in its first position and to locate the nozzle out of the sump and in a position for dispensing adhesive when the sump is in its second position.

2. The invention as set forth in claim 1 wherein the cam surface of the cam plate comprises two arcuate portions that meet at a point, the cam member is circular in shape and fits between the cam surfaces, and the drive means comprises a drive shaft eccentrically connected to the cam member for moving the cam member about an annular path and into contact with first one and then the other of the cam surfaces.

3. The invention as set forth in claim 2 wherein the carrier comprises a plate mounted for reciprocating movement adjacent the cam plate, the carrier plate and cam member being interconnected by a pin and slot arrangement so that movement of the cam member by the drive shaft effects reciprocating movement of the carrier plate.

4. Apparatus for moving an adhesive applicator between a storage position and a dispensing position, comprising:

a mounting plate;

a nozzle assembly having a nozzle tip end through which adhesive can be dispensed, the nozzle assembly being carried by said mounting plate;

a pivotally mounted cam plate having first and second spaced cam surfaces;

a sump secured to said cam plate and adapted to receive the tip of the nozzle assembly and a solvent for adhesive dispensed by the tip so that adhesive in the tip does not dry out and clog the end of the tip when the tip is located below the surface of solvent in the sump;

a cam positioned between said cam surfaces of said cam plate and adapted to engage one cam surface or the other cam surface to effect pivotal movement of the cam plate in a first direction or a second direction, thereby to move the sump between a first position where the sump is located to receive the tip of the nozzle assembly and a second position where the sump is located away from the tip of the nozzle assembly; and means connected to said cam and to said mounting plate for effecting reciprocating movement of said mounting plate in response to movement of the cam so that the mounting plate can initially be positioned with the tip of the nozzle assembly in the sump and moved in response to rotation of the cam first to an elevated position to lift the nozzle tip out of the plate and then moved to a lowered position for dispensing adhesive from the nozzle, and the cam plate being pivotal by the cam from its first position to its second position after the nozzle tip has been removed from the sump and returned to its first position after the nozzle tip has been moved to an elevated position.

* * * * *